United States Patent [19]

Storey

[11] Patent Number: 4,776,550

[45] Date of Patent: Oct. 11, 1988

[54] PAINT BUCKET HOLDER FOR LADDER

[76] Inventor: Willie J. Storey, 320 Newbridge St., Menlo Park, Calif. 94025

[21] Appl. No.: 83,591

[22] Filed: Aug. 6, 1987

[51] Int. Cl.[4] ..... E06C 7/14

[52] U.S. Cl. ..... 248/210; 182/129

[58] Field of Search ..... 182/129; 248/210, 211, 248/238

[56] References Cited

U.S. PATENT DOCUMENTS

| | | | |
|---|---|---|---|
| 1,221,658 | 4/1917 | Berry | 248/210 |
| 1,900,636 | 3/1933 | Davis | 248/210 |
| 2,212,384 | 8/1940 | Brandel | 248/210 |
| 2,759,620 | 8/1956 | Pharris | 248/211 |
| 2,883,134 | 4/1959 | O'Halloran | 248/210 |
| 2,990,152 | 6/1961 | Whitney | 248/210 |
| 3,131,900 | 5/1964 | Anderson | 248/210 |
| 3,987,993 | 10/1976 | Hopkins | 248/210 |
| 4,032,100 | 6/1977 | Kahn | 248/211 |
| 4,222,541 | 9/1980 | Cillis | 248/210 |

*Primary Examiner*—Reinaldo P. Machado
*Attorney, Agent, or Firm*—Townsend & Townsend

[57] ABSTRACT

A holder for a paint bucket for attachment of the paint bucket to the side of a ladder. The holder includes a holder body secured by an indexing plate to a clamp so that the clamp can attach the paint bucket holder body to the ladder. The indexing plate has notches on the lower, curved, outer periphery thereof, the plate being coupled rigidly to one side piece of the holder body. A vertical bar is rotatably mounted on the indexing plate and carries a beeper which is biased towards the lower periphery of the indexing plate so that the keeper will enter a notch in the plate when the notch is aligned with one end of the keeper after the holder has been rotated to a predetermined angle relative to the clamp. In this way, the angle of tilt of the paint bucket can be easily changed want desired or needed, yet the holder body will at all times safely and properly support a paint bucket at the desired level and angle with reference to the clamp.

4 Claims, 1 Drawing Sheet

PAINT BUCKET HOLDER FOR LADDER

This relates to improvements in holders for paint buckets and, more particularly to a holder attachable to the side of a ladder for holding a paint bucket on the ladder.

BACKGROUND OF THE INVENTION

Holders for mounting paint buckets on ladders have been known and used in the past. Typical of these holders are disclosed in U.S. Pat. Nos. 2,883,134, 3,131,900, 3,987,993, 4,222,541 and 4,386,753. 3,131,900 shows a paint bucket holder for the side rail of a ladder. The holder has a basket 7 secured by a threaded bolt 11 to a clamp 15 which clamps onto the side rail of the ladder. By rotating a bar 13 on bolt 11 the bar forces a sleeve 12 against the side strap 9 of basket 7. This action tightens the basket and prevents it from rotating. The basket itself-leveling when the bar 13 does not force sleeve 12 against strap 9.

U.S. Pat. No. 4,222,541 shows a basket or box mounted by a clamp at the side of a step ladder. The other patents show holders for use with ladders of various configurations.

For the most part, the paint bucket holders of the prior art have not been entirely satisfactory. For instance, the way in which a holder for a paint bucket can be tilted has never been satisfactory achieved. Thus, a need for providing a holder with adequate paint bucket tilting and leveling means is needed and the present invention satisfies this need.

SUMMARY OF THE INVENTION

The present invention is directed to a holder for a paint bucket for attachment of the paint bucket to the side of a ladder. The holder includes a holder body secured by an indexing means to a clamp so that the clamp can attach the paint bucket holder body to the ladder.

The indexing means includes an indexing plate having notches on the lower, curved, outer periphery thereof, the plate being coupled rigidly to one side piece of the holder body. A vertical bar is rotatably mounted on the indexing plate and carries a beeper which is biased towards the lower periphery of the indexing plate so that the beeper will enter a notch in the plate when the notch is aligned with one end of the keeper after the holder has been rotated to a predetermined angle relative to the clamp. In this way, the angle of tilt of the paint bucket can be easily changed when desired or needed, yet the holder body will at all times safely and properly support a paint bucket with the open upper end of the bucket at the desired level and angle with reference to the clamp.

The primary object of the present invention is to provide an improved holder for mounting a paint bucket on the side rail of a ladder wherein the holder includes a holder body for receiving the paint bucket and indexing means for coupling the holder to a clamp wherein the indexing means permits an easy way of adjusting the angle of tilt of the paint bucket relative to the ladder so that the paint bucket will be at the proper position at all times regardless of the angle which the ladder makes with the vertical wall against which the ladder is engaged.

Other objects of this invention will become apparent as the following specification progresses, reference being had to the accompanying drawings for an illustration of the invention.

IN THE DRAWINGS

Figure 1:
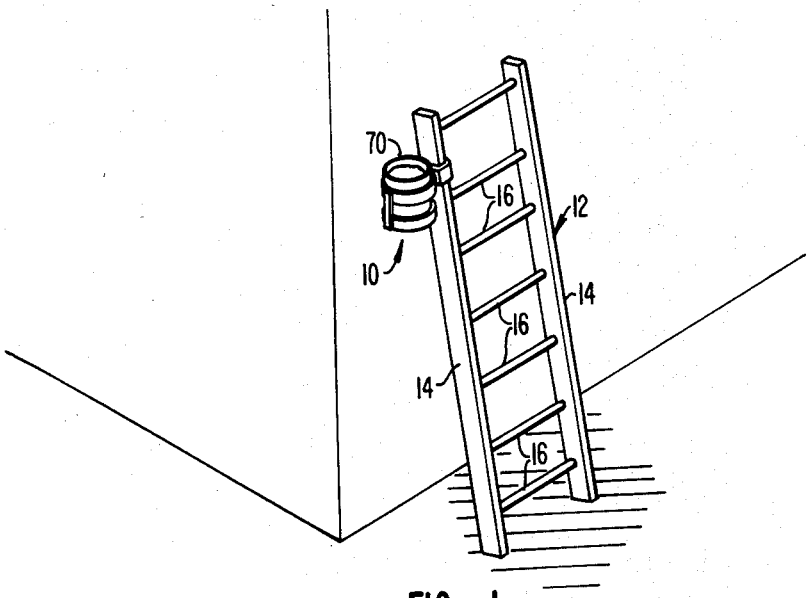
FIG. 1 is a perspective view of a ladder showing the bucket holder of the present invention attached to one side of the ladder.

The paint bucket holder of the present invention is broadly denoted by the numeral 10 and is adapted to be mounted on a ladder 12 of the type having a pair of side rails 14 and a plurality of rungs 16 spanning the distance between and coupled to rails 14 as shown in FIG. 1. Paint bucket holder 10 can be of any suitable size. Typically, it will of a size capable of holding a one gallon can of paint. Also, it can hold cans smaller in size than a one gallon size if it is big enough to hold a one gallon size.

Figure 2:
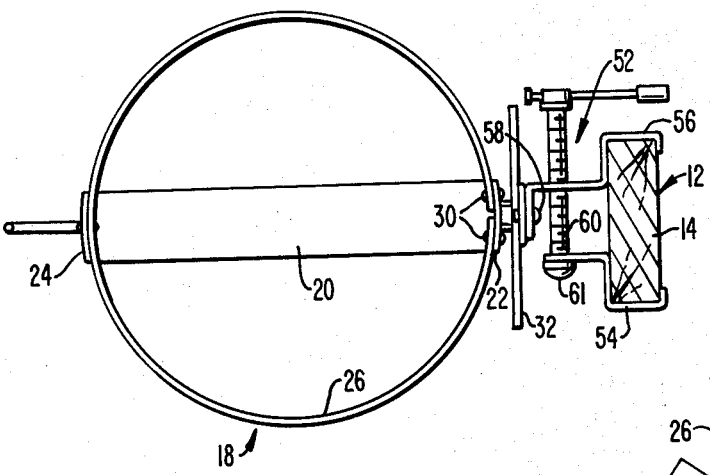
FIG. 2 is an enlarged, top plan view of the bucket holder, showing the way it is mounted on the side of a ladder.

Holder 10 includes a bucket-receiving part 18 comprised of a rigid bottom strap 20 having vertical side pieces 22 and 24. A pair of vertically spaced, cylindrical side bands 26 and 28 coupled to side pieces 22 and 24 by any suitable fastener means, such as by rivets. Strap 20 side pieces 22 and 24 and bands 26 and 28 are generally rigid in construction. Aluminum is a typical material for use in making these components. As shown in FIG. 2, band 26 is formed from a single length of rigid material and has its opposed ends coupled by rivets 30 to the upper end of side piece 22 of strap 20 as shown in FIG. 2. Similarly, the ends of lower band 28 are coupled by fastener means to lower the part of side piece 22 of bottom strap 20.

Figure 3:
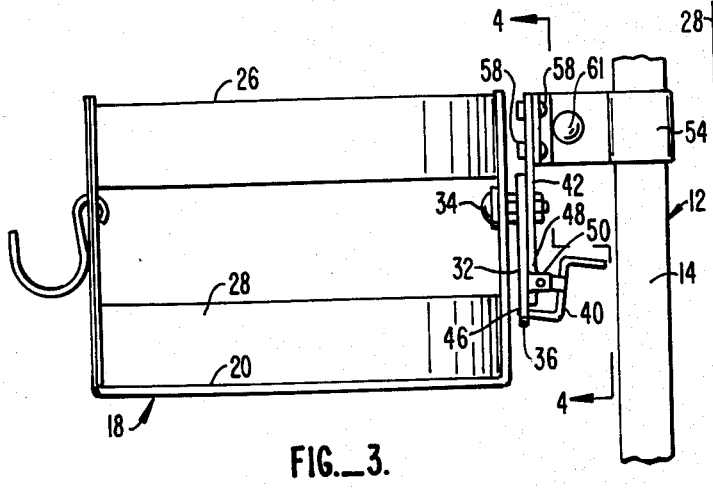
FIG. 3 is a side elevational view of the bucket holder.

An indexing plate 32 is secured by a bolt and nut assembly 34 to side piece 22 of bottom strap 20 so that plate 32 is rigidly coupled to but spaced outwardly from side piece 22 as shown in FIG. 3. The indexing plate 32 has a curved lower periphery 36 (FIG. 4) provided with notches 38 therein for receiving the lower end of a keeper 40 as hereinafter described.

Figure 4:
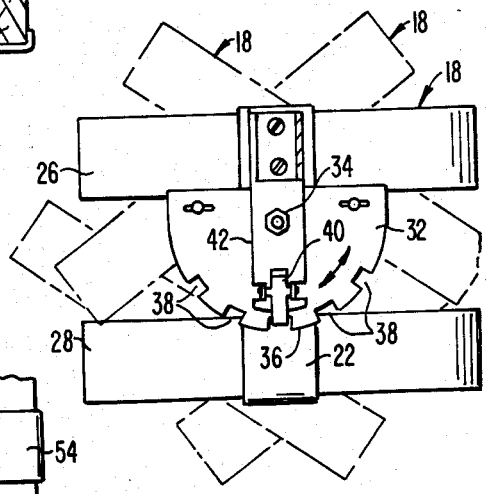
FIG. 4 is a cross-sectional view taken along line 4—4 of FIG. 3.

A rigid bar 42 is pivotally mounted by a nut and bolt assembly 34 on indexing plate 32, the bolt of assembly 34 also passing through side piece 22 as shown in FIG. 3. Bar 42 has keeper 40 pivotally mounted thereon as shown in FIGS. 3 and 4. To this end, keeper 40 is generally S-shaped in configuration as shown in FIG. 3 and the center portion of keeper 40 has a pin 46 coupled with a pair of ears 48 integral with bar 42. A coil spring 50 is provided about pin 46 to bias the keeper 40 in a clockwise sense when viewing FIG. 3. Thus, the lower end of follower 40 will enter a notch 38 in plate 32 when the notch is aligned with the keeper, thereby releasably locking the indexing plate 32 in a fixed position relative to bar 42.

The foregoing structure including indexing plate 32, bar 42 and keeper 40 is provided to permit tilting of holder 10 when the ladder is mounted by a clamp 52 on the side rail 14 of the ladder 12 in the manner shown in FIGS. 2 and 3. To this end, the clamp 52 includes a pair of clamping members 54 and 56, member 56 being rigid by rivets 58 to bar 42. The members 54 and 56 are coupled together by a screw 60 which is rotatably carried on member 54 but threadably coupled to member 56. A head 61 on screw 60 holds it on member 54.

In use, clamp 52 is placed on the side rail 14 of a ladder 12 and the clamp is at a desired height along the ladder as shown in FIG. 1. By rotating screw 60, clamp members 54 and 56 are brought together so that they releasably clamp onto side rail 14.

It is generally desirable to tilt container 18 to the preferred angle for holding the paint bucket 10 which is to be placed in the holder body 18. To this end, keeper 40 is caused to rotate in a counter clockwise sense when viewing FIG. 3 to permit manual movement of holder body 18 about the axis of nut and bolt combination 44, whereby indexing plate 32 moves relative to bar 42 until the right angle of the container is achieved. When this occurs, keeper 40 is released and allowed to move into the next notch 38 next closest to the preferred position or desired position of holder body 18. Typical positions of holder body 18 are shown in FIG. 4. When the desired angle of tilt of the container 18 has been achieved, the holder 10 is ready to hold a bucket of paint and the bucket 20 is manually carried to holder 10 and placed in the holder. Tilting or the holder body 18 can be done before or after the paint bucket is placed in the holder body 18.

The paint can holder 10 is sufficiently close to the side rail 14 so that there will be a stable connection of the holder 10 to the ladder. Also, the ladder can be moved even with the paint bucket is in the holder itself.

The present invention provides a safe means for holding a paint bucket on the side of a ladder. Moreover, the holder is simple and rugged in construction, is inexpensive to manufacture, and can be used over and over again without need for repair or replacement.

I claim:

1. A holder for a paint bucket comprising:

a holder body having an open top and adapted to receive a paint bucket for supporting the same in a generally upright position;

a clamp for releasable attachment to the side of a ladder; and indexing means for coupling the holder body to the clamp to allow the holder body to be moved into and out of any one of a number of operative positions with the upper end of the holder body tilted relative to the horizontal, said indexing means including an indexing plate carried by the holder body and a bar carried by the clamp, the bar being rotatably mounted on the plate, means for releasably and rotatably coupling the bar to the plate, keeper means carried by the bar at the lower end thereof, said plate having a number of spaced notches therein for releasably receiving one end of the keeper means, the lower end of the keeper means being biased towards the notches in the plate, said plate having a lower, curved outer periphery, the notches being in said outer periphery and having lower open ends for receiving the end of the keeper means.

2. A holder for a paint bucket comprising:

a holder body having an open top and adapted to receive a paint bucket for supporting the same in a generally upright position, said holder body including a bottom strap provided with a pair of diametrically opposed side pieces, and a pair of vertically spaced bands secured to the side pieces;

a clamp for releasable attachment to the side of a ladder; and indexing means for coupling the holder body to the clamp to allow the holdeer body to be moved into and out of any one of a number of operative positions with the upper end of the holder body tilted relative to the horizontal, said indexing means including an indexing plate rigid to one of the side pieces of the bottom strap, a vertical bar rotatably mounted on said plate and having a keeper at one end thereof, said plate having circumferentially spaced notches on the lower, outer periphery thereof, said follower being movable with the bar into and out of alignment with any one of the notches, and means biasing the keeper into a notch aligned therewith.

3. A holder as set forth in claim 2, wherein the keeper is pivotally mounted on the lower end of the bar.

4. A holder as set forth in claim 3, wherein is included a clamp carried by the bar for releasably attaching the holder body to a side rail of a ladder.

* * * * *